US012709822B2

(12) United States Patent
Fujisawa

(10) Patent No.: US 12,709,822 B2
(45) Date of Patent: Aug. 18, 2026

(54) INDUSTRIAL FABRIC

(71) Applicant: NIPPON FILCON CO., LTD., Tokyo (JP)

(72) Inventor: Shigenobu Fujisawa, Shizuoka (JP)

(73) Assignee: NIPPON FILCON CO., LTD., Tokyo (JP)

( * ) Notice: Subject to any disclaimer, the term of this patent is extended or adjusted under 35 U.S.C. 154(b) by 113 days.

(21) Appl. No.: 18/932,153

(22) Filed: Oct. 30, 2024

(65) Prior Publication Data

US 2025/0051979 A1 Feb. 13, 2025

Related U.S. Application Data

(63) Continuation of application No. PCT/JP2023/027135, filed on Jul. 25, 2023.

(30) Foreign Application Priority Data

Aug. 5, 2022 (JP) ..... 2022-125403

(51) Int. Cl.
*D03D 13/00* (2006.01)
*D21F 7/08* (2006.01)
*D21F 7/06* (2006.01)

(52) U.S. Cl.
CPC ..... *D03D 13/004* (2013.01); *D21F 7/083* (2013.01); *D10B 2403/012* (2013.01); *D10B 2505/00* (2013.01)

(58) Field of Classification Search
CPC ..... D03D 13/004; D21F 7/083; D10B 2403/013; D10B 2505/00
See application file for complete search history.

(56) References Cited

U.S. PATENT DOCUMENTS 12,371,825 B2 * 7/2025 Fujisawa ..... D03D 13/004
2006/0231154 A1 * 10/2006 Hay ..... D21F 1/0045 139/383 A (Continued)

FOREIGN PATENT DOCUMENTS

CN 1732302 A 2/2006
CN 106255779 A 12/2016

(Continued)

OTHER PUBLICATIONS

International Search Report and Written Opinion issued in International Application No. PCT/JP2023/027135, mailed Oct. 24, 2023.

(Continued)

*Primary Examiner* — Katharine G Kane
(74) *Attorney, Agent, or Firm* — Michael Best & Friedrich LLP

(57) ABSTRACT

An industrial fabric that includes: an upper surface side fabric including upper surface side warps and upper surface side wefts; a lower surface side fabric including lower surface side warps and lower surface side wefts; and binding warps that bind the upper surface side fabric and the lower surface side fabric and that constitute a portion of the upper surface side fabric and a portion of the lower surface side fabric, includes: first warp pairs that are each formed by a pair of binding warps that are vertically adjacent to each other; and second warp pairs that are formed by the upper surface side warps and the lower surface side warps that are vertically adjacent to each other.

9 Claims, 4 Drawing Sheets

(56) References Cited

U.S. PATENT DOCUMENTS

| | | | | |
|---|---|---|---|---|
| 2007/0095416 | A1 | 5/2007 | Ueda | |
| 2008/0105323 | A1* | 5/2008 | Hay | D21F 1/0045 139/383 A |
| 2008/0149213 | A1* | 6/2008 | Quigley | D21F 1/0045 139/408 |
| 2008/0149214 | A1* | 6/2008 | Quigley | D21F 1/0045 139/410 |
| 2009/0205740 | A1* | 8/2009 | Quigley | D21F 1/0045 139/408 |
| 2015/0013821 | A1 | 1/2015 | Ueda | |
| 2018/0142385 | A1 | 5/2018 | Ueda | |
| 2019/0153633 | A1 | 5/2019 | Ueda et al. | |
| 2023/0160110 | A1* | 5/2023 | Fujisawa | D03D 13/004 442/203 |

FOREIGN PATENT DOCUMENTS

| | | | |
|---|---|---|---|
| JP | 2002-013087 | A | 1/2002 |
| JP | 2003-342889 | A | 12/2003 |
| JP | 2008-057052 | A | 3/2008 |
| JP | 2015-017340 | A | 1/2015 |
| JP | 2019-178437 | A | 10/2019 |
| WO | 2016-158640 | A1 | 10/2016 |

OTHER PUBLICATIONS

Extended Search Report issued in European Application No. 23849952.9-1015, dated Jul. 11, 2025.

Office Action issued in Chinese Application No. 202380013855.5, dated Jan. 19, 2026.

* cited by examiner

INDUSTRIAL FABRIC

BACKGROUND

1. Technical Field

The present disclosure relates to industrial fabrics used for paper machines.

2. Background Information

In the related art, papermaking meshes made of warps and wefts have been widely used as industrial fabrics for paper machines. The characteristics required for the papermaking meshes vary. For example, Patent Literature 1 discloses an industrial two-layer fabric in which a plurality of warp pairs each including an upper surface side warp and an adjacent lower surface side warp have a first warp pair consisting of a warp binding yarn that joins an upper surface side fabric and a lower surface side fabric and a second warp pair having no warp binding yarn. In a weave repeat of an industrial two-layer fabric, four sets of first warp pairs and four sets of second warp pairs are arranged.

PATENT LITERATURE 1: JP 2015-017340

In the technology described in Patent Literature 1, there is a possibility that the force binding the upper surface side fabric and the lower surface side fabric becomes weaker, causing internal friction between the upper surface side fabric and the lower surface side fabric. On the other hand, since a depression occurs in the upper surface side fabric at a part where a warp bonding yarn is woven from the upper surface side fabric into the lower surface side fabric, if the ratio of the number of warp binding yarns in the warps forming the fabrics is too large, the surface smoothness of the fabrics may be reduced.

SUMMARY

A purpose of the present disclosure is to provide industrial fabrics that suppress a decrease in surface smoothness while ensuring sufficient binding force between an upper surface side fabric and a lower surface side fabric.

Solution to Problem

In order to solve the above problem, one embodiment of the present invention relates to an industrial fabric that includes: an upper surface side fabric including upper surface side warps and upper surface side wefts; a lower surface side fabric including lower surface side warps and lower surface side wefts; and binding warps that bind the upper surface side fabric and the lower surface side fabric and that constitute a portion of the upper surface side fabric and a portion of the lower surface side fabric, and includes: first warp pairs that are each formed by a pair of binding warps that are vertically adjacent to each other; and second warp pairs that are formed by the upper surface side warps and the lower surface side warps that are vertically adjacent to each other. The upper surface side warps are woven only into the upper surface side wefts, the lower surface side warps are woven only into the lower surface side wefts, and a weaving pattern is repeated that is formed by first warp pairs lined up in sets of three in a weft direction and second warp pairs arranged being adjacent to the first warp pairs lined up in sets of three in the weft direction.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

The invention will now be described by reference to the preferred embodiments. This does not intend to limit the scope of the present invention, but to exemplify the invention. In the following explanation, "warps" are threads extending along the direction of conveyance of paper materials, and "wefts" are threads extending in a direction that intersects the warps, when a multi-layered fabric for papermaking constitutes a looped belt. Further, an "upper surface side fabric" is a fabric located on the upper surface side where the paper materials are conveyed out of the two sides of a papermaking mesh when a multi-layered fabric is used as the papermaking mesh, and a "lower surface side fabric" is a fabric located mainly on the lower surface side where a drive roller is in contact out of the two sides of a papermaking belt. An "obverse surface" simply means a surface on the side where the upper surface side fabric or the lower surface side fabric is exposed. While the "obverse surface" of the upper surface side fabric corresponds to the outer surface side of a papermaking mesh, the "obverse surface" of the lower surface side fabric corresponds to the inner surface side of the papermaking mesh.

Further, a term "design diagram" represents the minimum repeating unit of a textile texture and corresponds to a weave repeat of the textile. In other words, a "weave repeat" is repeated from front to back and left to right to form a "textile". Further, "knuckles" refers to parts where a warp is exposed on the obverse surface after passing above or below a single or multiple wefts.

Further, "binding warps" means at least some of warps that form the upper surface side fabric and the lower surface side fabric and are warps that bind the upper surface side fabric with the lower surface side fabric by being woven into both the upper surface side fabric and the lower surface side fabric.

First Exemplary Embodiment

Figure 1:
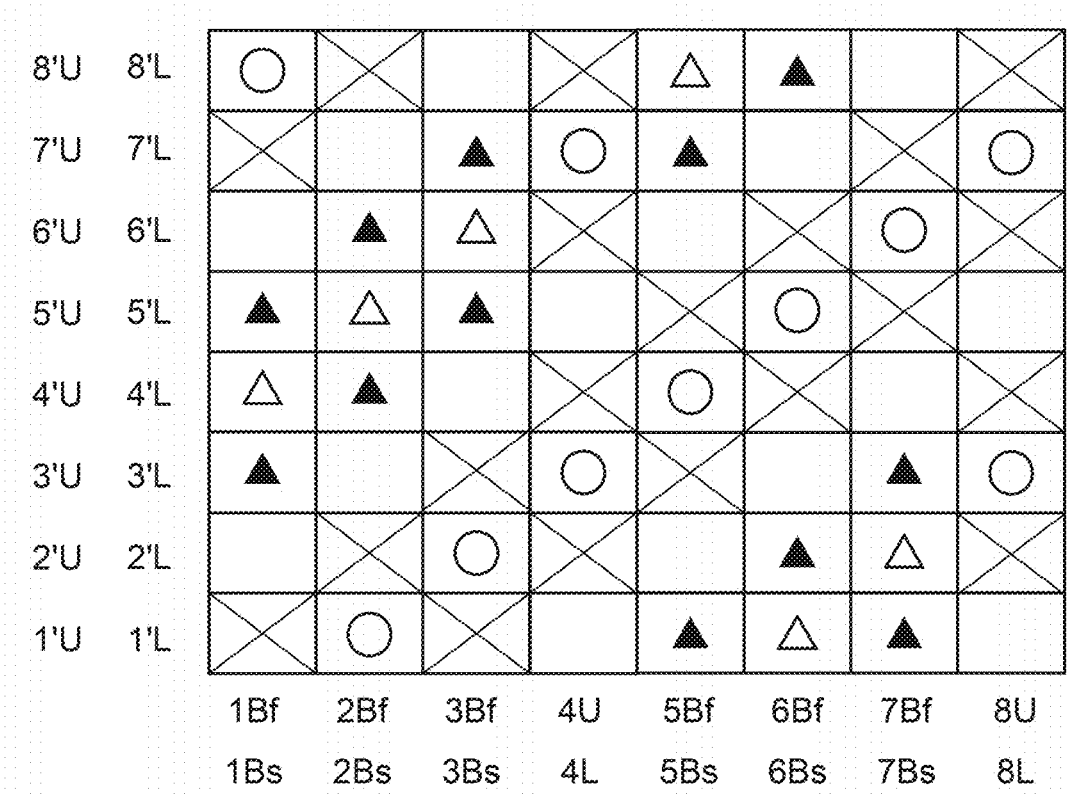
FIG. 1 is a design diagram showing a weave repeat of an industrial fabric according to the first exemplary embodiment.

FIG. 1 is a design diagram showing a weave repeat of an industrial fabric 10 according to the first exemplary embodiment. FIG. 2 is a cross-sectional view in the warp direction along warps of the industrial fabric 10 shown in FIG. 1.

In the design diagrams, warps are represented by Arabic numerals, for example, 1, 2, 3, and so on. Wefts are represented by Arabic numerals with a dash, for example, 1', 2', 3', and so on. Upper surface side yarns are denoted by numbers with "U," and lower surface side yarns are denoted by numbers with "L," e.g., an upper surface side warp 1U, a lower surface side weft 2'L, etc. Binding yarns binding the upper surface side fabric and the lower surface side fabric are denoted by numbers with "B," and a first binding warp and a second binding warp are denoted as Bf and Bs, respectively.

In the design diagrams, x marks indicate that upper surface side warps and first binding warps are arranged above upper surface side wefts, ○ marks indicate lower surface side warps and second binding warps are arranged below lower surface side wefts, Δ marks indicate that the first binding warps are arranged below the lower surface side wefts, and ▲ marks indicate that the second binding warps are arranged above the upper surface side wefts. The x marks, the ○ marks, the Δ marks, and the ▲ marks indicate knuckles.

The industrial fabric 10 according to the first exemplary embodiment shown in FIG. 1 includes an upper surface side fabric formed including upper surface side warps (4U and 8U) and upper surface side wefts (1'U to 8'U), a lower surface side fabric formed including lower surface side warps (4L and 8L) and lower surface side wefts (1'L to 8'L), and binding warps that bind the upper surface side fabric and the lower surface side fabric.

The binding warps are woven into both the upper surface side wefts (1'U to 8'U) and the lower surface side wefts (1'L to 8'L). The binding warps include first binding warps (1Bf to 3Bf and 5Bf to 7Bf) and second binding warps (1Bs to 3Bs and 5Bs to 7Bs) and constitute a portion of the upper surface side fabric and a portion of the lower surface side fabric. In a weave repeat, there are six first binding warps (1Bf to 3Bf and 5Bf to 7Bf) and six second binding warps (1Bs to 3Bs and 5Bs to 7Bs) as well. The first binding warps (1Bf to 3Bf and 5Bf to 7Bf) and the second binding warps (1Bs to 3Bs and 5Bs to 7Bs) are vertically adjacent to each other and constitute six sets of first warp pairs (1 to 3 and 5 to 7) in the weave repeat.

The upper surface side warps (4U and 8U) are interwoven only with the upper surface side wefts (1'U to 8'U). The lower surface side warps (4L and 8L) are interwoven only with the lower surface side wefts (1'L to 8'L). The upper surface side warps (4U and 8U) and the lower surface side warps (4L and 8L) are vertically adjacent to each other and constitute two sets of second warp pairs (4 and 8) in the weave repeat, and two of each are used. There are eight upper surface side wefts (1'U to 8'U) and eight lower surface side wefts (1'L to 8'L) each in the weave repeat.

The weaving method of each warp and each weft in the industrial fabric 10 will be explained next with reference to FIGS. 2A and 2B. The upper surface side wefts (1'U to 8'U) and the lower surface side wefts (1'L to 8'L) shown in FIGS. 2A and 2B are arranged in the same manner.

Figure 2A:
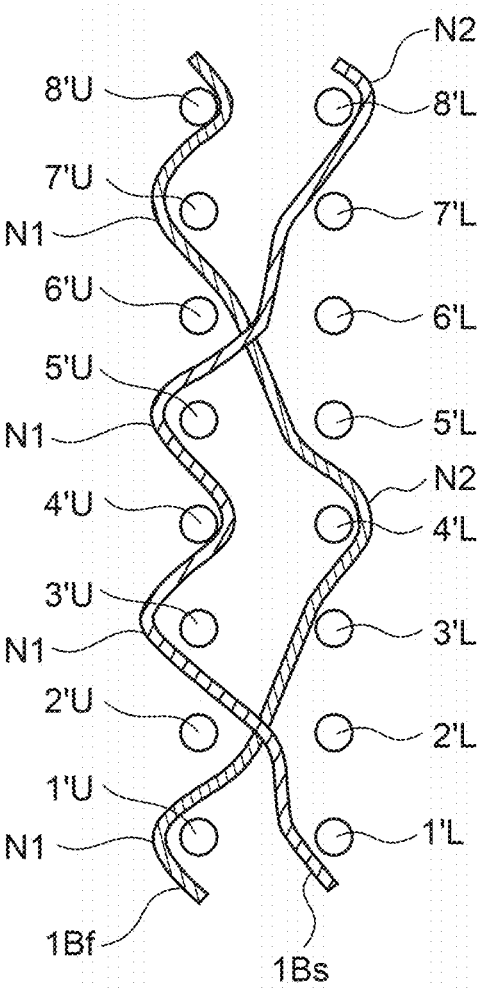
FIGS. 2A and 2B are cross-sectional views in the warp direction along warps of the industrial fabric shown in FIG. 1.
Figure 2B:
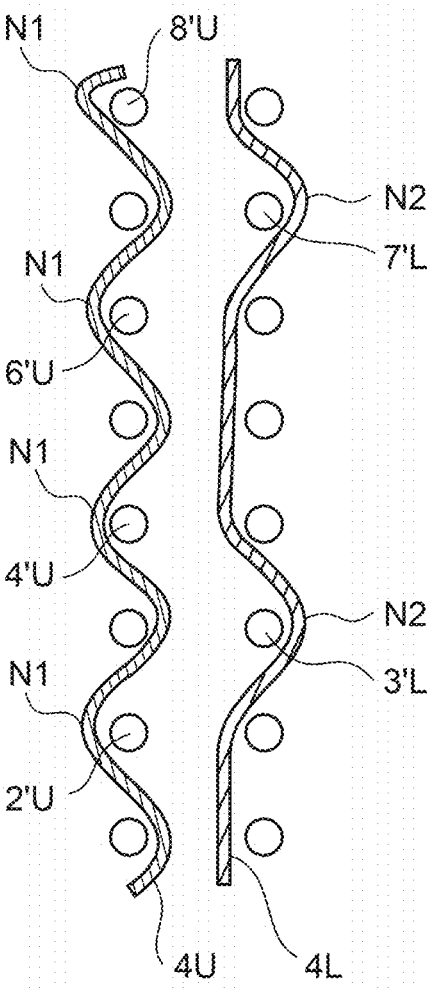

FIG. 2A shows a form in which a first warp pair formed by the first binding warp 1Bf and the second binding warp 1Bs is woven into the upper surface side wefts (1'U to 8'U) and the lower surface side wefts (1'L to 8'L). As shown in FIG. 2A, the first binding warp 1Bf and the second binding warp 1Bs form a first warp pair 1 being adjacent to each other vertically and intersect with each other for binding.

The first binding warp 1Bf passes above the upper surface side wefts (1'U and 7'U) so as to form two upper surface side knuckles N1 and passes below the upper surface side wefts (2'U to 6'U and 8'U). The first binding warp 1Bf passes below the lower surface side weft 4'L so as to form one lower surface side knuckle N2 and passes above the lower surface side wefts (1'L to 3'L and 5'L to 8'L). In other words, the first binding warp 1Bf forms two upper surface side knuckles N1 at the upper surface side wefts (1'U and 7'U) and forms one lower surface side knuckle N2 at the lower surface side weft 4'L.

Although the first binding warps (2Bf to 3Bf and 5Bf to 7Bf) include those whose weaving position is shifted in the warp direction from that of the first binding warp 1Bf, the first binding warps (2Bf to 3Bf and 5Bf to 7Bf) have a weaving pattern that is in common with the weaving pattern of the first binding warp 1Bf, form two upper surface side knuckles N1, and form one lower surface side knuckle N2.

The second binding warp 1Bs passes above the upper surface side wefts (3'U and 5'U) so as to form two upper surface side knuckles N1 and passes below the upper surface side wefts (1'U, 2'U, 4'U, and 6'U to 8'U). The second binding warp 1Bs passes below the lower surface side weft 8'L so as to form one lower surface side knuckle N2 and passes above the lower surface side wefts (1'L to 7'L). In other words, the second binding warp 1Bs forms two upper surface side knuckles N1 at the upper surface side wefts (3'U and 5'U) and forms one lower surface side knuckle N2 at the lower surface side weft 8'L.

Although the second binding warps (2Bs to 3Bs and 5Bs to 7Bs) include those whose weaving position is shifted in the warp direction from that of the second binding warp 1Bs, the second binding warps (2Bs to 3Bs and 5Bs to 7Bs) have a weaving pattern that is in common with the weaving pattern of the second binding warp 1Bs, form two upper surface side knuckles N1, and form one lower surface side knuckle N2. In this manner, the first binding warps (1Bf to 3Bf and 5Bf to 7Bf) and the second binding warps (1Bs to 3Bs and 5Bs to 7Bs) form two upper surface side knuckles N1, form one lower surface side knuckle N2, and form a weaving pattern that is in common with each other. The first and second binding warps share a weaving pattern that is in common with each other.

Each warp of the first warp pair 1 formed by the first binding warp 1Bf and the second binding warp 1Bs forms two upper surface side knuckles N1, thereby forming a weaving pattern of weaving the upper surface side wefts (1'U to 8'U) above and below alternately one by one on the obverse surface of the upper surface side fabric. In the same manner, the first warp pair formed by the first binding warps (2Bf to 3Bf and 5Bf to 7Bf) and the second binding warps (2Bs to 3Bs and 5Bs to 7Bs) also forms a weaving pattern of weaving the upper surface side wefts (1'U to 8'U) above and below the warp pair alternately one by one on the obverse surface of the upper surface side fabric. As described, the first warp pairs (1 to 3 and 5 to 7) form knuckles at constant intervals with respect to the upper surface side wefts (1'U to 8'U), form a weaving pattern that is in common with each other for plain weave, and interwoven without destroying the obverse surface texture.

Each warp of the first binding warp pair 1 formed by the first binding warp 1Bf and the second binding warp 1Bs forms one lower surface side knuckle N2, thereby forming a weaving pattern of passing below one lower surface side weft (4'L and 8'L) and passing above three consecutive lower surface side wefts (1'L to 3'L and 5'L to 7'L), which is a so-called weaving pattern for ⅓ weave. In the same manner, the first warp pair formed by the first binding warps (2Bf to 3Bf and 5Bf to 7Bf) and the second binding warps (2Bs to 3Bs and 5Bs to 7Bs) also forms a weaving pattern for ⅓ weave. As described, the first warp pairs (1 to 3 and 5 to 7) form knuckles at constant intervals with respect to the lower surface side wefts (1'L to 8'L), form a weaving pattern that is in common with each other for ⅓ weave, and interwoven without destroying the obverse surface texture.

FIG. 2B shows a form in which a second warp pair 4 formed by the upper surface side warp 4U and the lower surface side warp 4L is interwoven with the upper surface side wefts (1'U to 8'U) and the lower surface side wefts (1'L to 8'L). As shown in FIG. 2B, the upper surface side warp 4U is woven only into the upper surface side wefts (1'U to 8'U), and the lower surface side warp 4L is woven only into the lower surface side wefts (1'L to 8'L).

The upper surface side warp 4U passes above the upper surface side wefts (2'U, 4'U, 6'U, and 8'U) so as to form upper surface side knuckles N1 and passes below the upper surface side wefts (1'U, 3'U, 5'U, and 7'U). The upper surface side warp 4U is woven into the upper surface side wefts (1'U to 8'U) in plain weave and forms a weaving pattern of weaving the upper surface side wefts (1'U to 8'U) above and below alternately one by one on the obverse surface of the upper surface side fabric.

The upper surface side warp 8U has the same weaving pattern as that of the upper surface side warp 4U and forms a weaving pattern of weaving the upper surface side wefts (1'U to 8'U) above and below alternately one by one.

The lower surface side warp 4L passes below one lower surface side weft (3'L and 7'L) so as to form a lower surface side knuckle N2, and passes above three consecutive lower surface side wefts (1'L to 2'L, 4'L to 6'L, and 8'L). The lower surface side warp 4L forms knuckles at constant intervals with respect to the lower surface side wefts (1'L to 8'L), and form a weaving pattern for ⅓ weave.

The lower surface side warp 8L forms knuckles at constant intervals with respect to the lower surface side wefts (1'L to 8'L), and form the same weaving pattern for ⅓ weave as that of the lower surface side warp 4L.

Warps located on the upper surface side including the upper surface side warps (4U and 8U) and the binding warps (1Bf to 3Bf, 5Bf to 7Bf, 1Bs to 3Bs, and 5Bs to 7Bs) form a weaving pattern where the upper surface side wefts are woven above and below alternately one by one on the obverse surface of the upper surface side fabric. The warps located on the upper surface side refer to warps that are exposed on the obverse surface on the upper surface side. That is, the first warp pair (1 to 3 and 5 to 7) and the second warp pair (4 and 8) form a weaving pattern that is in common with each other on the obverse surface of the upper surface side fabric. This allows the surface properties of the upper surface side fabric to be improved. Further, by making the surface of the upper surface side fabric into a plain weave, good smoothness and support for paper fibers can be obtained, and it is thus possible to reduce the number of parts where paper fibers can get stuck.

Warps located on the lower surface side including the lower surface side warps (4L and 8L) and the binding warps (1Bf to 3Bf, 5Bf to 7Bf, 1Bs to 3Bs, and 5Bs to 7Bs) repeatedly form a weaving pattern of passing below one lower surface side weft and passing above three consecutive lower surface side wefts on the obverse surface of the lower surface side fabric. The warps located on the lower surface side refer to warps that are exposed on the obverse surface on the lower surface side. That is, the first warp pair and the second warp pair form a weaving pattern that is in common with each other on the obverse surface of the upper surface side fabric. As a result, compared to plain weave, the number of lower surface side wefts exposed on the obverse surface of the lower surface side fabric can be increased, and abrasion resistance can be improved.

The binding warps are woven into the upper surface side wefts and the lower surface side wefts in the weaving pattern that is in common with each other. In other words, the first binding warps (1Bf to 3Bf and 5Bf to 7Bf) and the second binding warps (1Bs to 3Bs and 5Bs to 7Bs) are woven into the upper surface side wefts (1'U to 8'U) in the weaving pattern that is in common with each other to form a plain weave, and the first binding warps (1Bf to 3Bf and 5Bf to 7Bf) and the second binding warps (1Bs to 3Bs and 5Bs to 7Bs) are woven into the lower surface side wefts (1'L to 8'L) in the weaving pattern that is in common with each other to form a weaving pattern that is in common with each other for ⅓ weave. This allows for suppression of a decrease in the surface properties of the industrial fabric 10.

In the industrial fabric 10, a weaving pattern is repeated that is formed by first warp pairs (1 to 3 and 5 to 7) lined up in sets of three in the weft direction and second warp pairs (4 and 8) arranged being adjacent respectively to the first warp pairs (1 to 3 and 5 to 7) lined up in sets of three in the weft direction. In other words, the second warp pairs are located between the first warp pairs lined up in sets of three, and one set of the second warp pairs is arranged adjacent to each of the sides of the three consecutive sets of first warp pairs. In a weave repeat, six out of the eight sets of warp pairs are binding warps, and the binding force of the upper surface side fabric and lower surface side fabric can be therefore improved compared to industrial fabrics with a small proportion of binding warps. By increasing the binding force, it is possible to suppress internal abrasion due to rubbing of the upper surface side fabric and the lower surface side fabric, and it is thus possible to suppress a decrease in dewatering performance due to fuzzing of the surface of the worn yarns. Further, when the first warp pairs are lined up in sets of three in a consecutive manner, the surface smoothness of the upper surface side fabric can be ensured, and the smoothness of the manufactured paper can also be improved. For example, when arrangement made in the order of "a first warp pair, an upper surface side warp, a first warp pair, a lower surface side warp" is employed, in a region where the upper surface side warp or the lower surface side warp exists alone in comparison with other regions, since the lower surface side warp or the upper surface side warp is missing, dewatering concentrates in the gap, which results in uneven dewatering speed that causes poor paper formation, and, furthermore, a groove is formed on the surface of the fabric where the upper surface side warp is missing, which deteriorates the smoothness of the paper. On the other hand, since the industrial fabric 10 is formed using only the first warp pairs and the second warp pairs, it is possible to prevent uneven dewatering speed.

When the upper surface side fabric is viewed in a plane-perpendicular direction, a range in which the first binding warps (1Bf to 3Bf and 5Bf to 7Bf) and the second binding warps (1Bs to 3Bs and 5Bs to 7Bs) forming the first warp pairs overlap is less than 50 percent. The plane-perpendicular direction of the upper surface side fabric is a direction perpendicular to the upper surface side fabric and is along the vertical direction. For example, a region where the first binding warp 1Bf overlaps the second binding warp 1Bs in the vertical direction is less than 50 percent of the area of the first binding warp 1Bf in planar view when viewed in the vertical direction and is less than 50 percent of the area of the second binding warp 1Bs in planar view when viewed in the vertical direction. Since the ratio of binding warps is large in the industrial fabric 10, if the first and second binding warps overlap each other by less than 50 percent, the first and second binding warps are shifted from each other in the weft direction, causing the industrial fabric 10 to have a structure in which the mesh is closed, which results in slow dewatering. Thereby, when a paper material is dropped on the industrial fabric 10 in the papermaking process, the paper fibers are evenly dispersed, and the paper is well aligned.

More preferably, when the upper surface side fabric is viewed in a plane-perpendicular direction, a range in which the first binding warps (1Bf to 3Bf and 5Bf to 7Bf) and the second binding warps (1Bs to 3Bs and 5Bs to 7Bs) forming the first warp pairs overlap may be less than 45 percent.

The warp density DW of warps including upper surface side warps, lower surface side warps, and binding warps calculated by the following Expression 1 is equal to 90 percent or more.

$$DW = (D \times M/25.4) \times 100 \qquad \text{Expression 1}$$

DW represents the warp density, D represents the diameter (in millimeters) of the upper surface side warps, the lower surface side warps, or the binding warps, and M indicates a mesh count, which refers to the number of warps per inch. Thereby, the warp density can be increased, and by shifting the binding warps in the weft direction, the industrial fabric 10 can have a closed structure, and dewatering can thus be slowed down. The warp density DW may preferably be 100 percent or more.

The positions of the upper surface side knuckles N1 (marked x and ▲ in FIG. 1) formed by two sets of first warp pairs that are adjacent in the weft direction are shifted by one upper surface side weft in the warp direction. The positions of the upper surface side knuckles N1 (marked x and ▲ in FIG. 1) formed by first warp pairs and upper surface side warps that are adjacent in the weft direction are shifted by one upper surface side weft in the warp direction. In other words, for every warp located on the upper surface side shifts by one in the weft direction, the upper surface side knuckle N1 shifts by one in the warp direction, and the industrial fabric 10 does not form a rib weave on the obverse surface of the upper surface side fabric. When upper surface side knuckles N1 formed by warps adjacent to each other in the weft direction are formed at the same position in the warp direction, that is, when the obverse surface of the upper surface side fabric is formed by rib weave, since the adjacent warps are paired and become close to each other, a gap is generated between pairs. On the other hand, since the upper surface side knuckles N1 are shifted in the warp direction for each adjacent warp pair and evenly arranged, the gap between the pairs can be reduced, and the unevenness of the dewatering speed can be suppressed, thereby preventing the occurrence of poor formation of the paper.

The positions of the lower surface side knuckles N2 (marked ○ and Δ in FIG. 1) formed by two sets of first warp pairs that are adjacent in the weft direction are shifted by one or more lower surface side wefts in the warp direction. The positions of the lower surface side knuckles N2 (marked ○ and Δ in FIG. 1) formed by lower surface side wefts and first warp pairs that are adjacent in the weft direction are shifted by one or more lower surface side wefts in the warp direction. In other words, for every warp located on the lower surface side shifts by one in the weft direction, the lower surface side knuckle N2 shifts by one or more in the warp direction, and the industrial fabric 10 does not form a rib weave on the obverse surface of the lower surface side fabric. Since the lower surface side knuckles N2 are shifted in the warp direction for each adjacent warp pair and evenly arranged, the unevenness of the dewatering speed can be suppressed, thereby preventing the occurrence of poor formation of the paper.

The upper surface side knuckles N1 (x and ▲ marks in FIG. 1) are arranged so as not to overlap the lower surface side knuckle N2 (○ and Δ marks in FIG. 1) in the vertical direction. Thereby, it is possible to suppress rubbing of the wefts that are pulled to the inner side of the industrial fabric 10 by the knuckles.

Second Exemplary Embodiment

Figure 3:
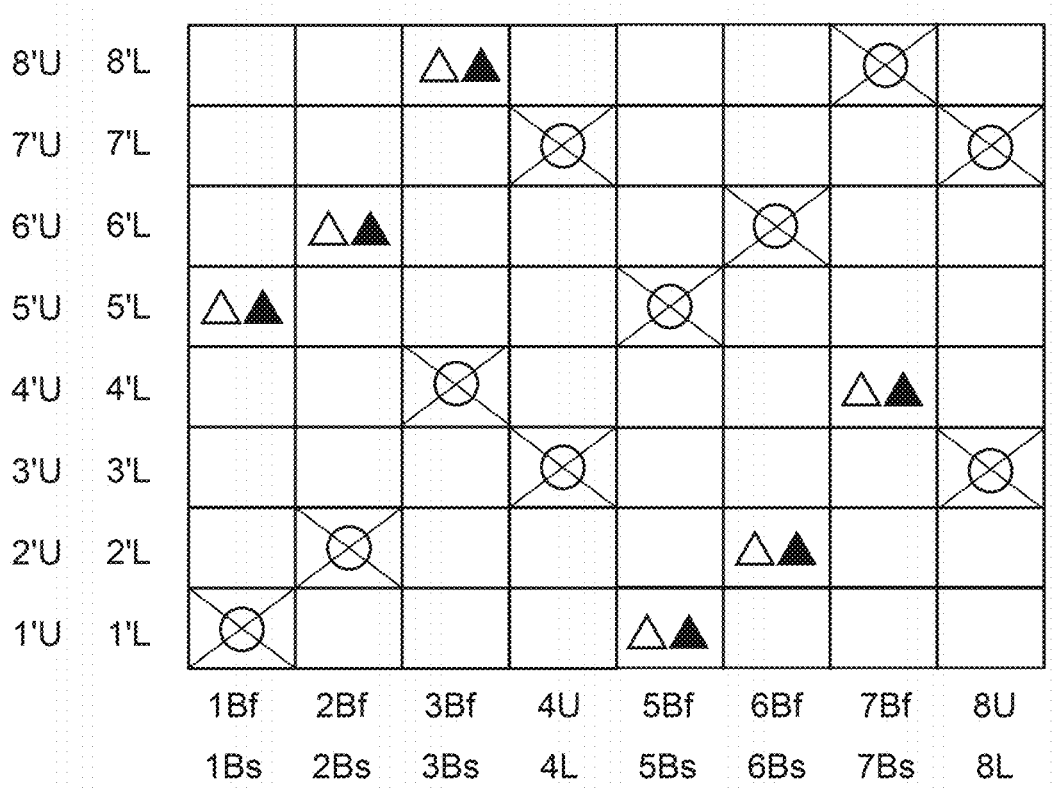
FIG. 3 is a design diagram showing a weave repeat of an industrial fabric according to the second exemplary embodiment.

FIG. 3 is a design diagram showing a weave repeat of an industrial fabric 100 according to the second exemplary embodiment. FIG. 4 is a cross-sectional view in the warp direction along warps of the industrial fabric 100 shown in FIG. 3.

The industrial fabric 100 according to the second exemplary embodiment shown in FIG. 3 is the same as the industrial fabric 10 shown in FIG. 1 in that the industrial fabric 100 has six first warp pairs (1 to 3 and 5 to 7) and two sets of second warp pairs (4 and 8) but is different in that it has a different warp weaving pattern.

Six first warp pairs (1 to 3 and 5 to 7) are formed by first binding warps (1Bf to 3Bf and 5Bf to 7Bf) and second binding warps (1Bs to 3Bs and 5Bs to 7Bs). Two sets of the second warp pairs (4 and 8) are formed by upper surface side warps (4U and 8U) and lower surface side warps (4L and 8L) that are adjacent to each other vertically.

Figure 4A:
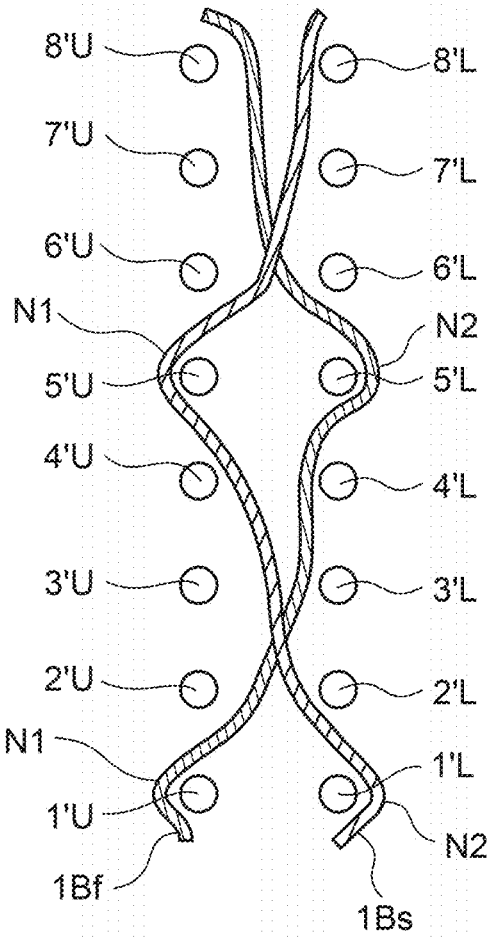
FIGS. 4A and 4B are cross-sectional views in the warp direction along warps of the industrial fabric shown in FIG. 3.

FIG. 4A shows a form in which a first warp pair 1 formed by a first binding warp 1Bf and a second binding warp 1Bs is woven into the upper surface side wefts (1'U to 8'U) and the lower surface side wefts (1'L to 8'L). The first binding warp 1Bf passes above the upper surface side weft 1'U so as to form one upper surface side knuckle N1 and passes below the upper surface side wefts (2'U and 8'U). The first binding warp 1Bf passes below the lower surface side weft 5'L so as to form one lower surface side knuckle N2 and passes above the lower surface side wefts (1'L to 4'L and 6'L to 8'L).

Although the first binding warps (2Bf to 3Bf and 5Bf to 7Bf) include those whose weaving position is shifted in the warp direction from that of the first binding warp 1Bf, the first binding warps (2Bf to 3Bf and 5Bf to 7Bf) have a weaving pattern that is in common with the weaving pattern of the first binding warp 1Bf, form one upper surface side knuckle N1, and form one lower surface side knuckle N2.

The second binding warp 1Bs passes above the upper surface side weft 5'U so as to form one upper surface side knuckle N1 and passes below the upper surface side wefts (1'U to 4'U and 6'U to 8'U). The second binding warp 1Bs passes below the lower surface side weft 1'L so as to form one lower surface side knuckle N2 and passes above the lower surface side wefts (2'L to 8'L). In other words, the second binding warp 1Bs forms one upper surface side knuckle N1 and forms one lower surface side knuckle N2.

Although the second binding warps (2Bs to 3Bs and 5Bs to 7Bs) include those whose weaving position is shifted in the warp direction from that of the second binding warp 1Bs, the second binding warps (2Bs to 3Bs and 5Bs to 7Bs) have a weaving pattern that is in common with the weaving pattern of the second binding warp 1Bs, form one upper surface side knuckle N1, and form one lower surface side knuckle N2. The first and second binding warps share a weaving pattern that is in common with each other.

Each warp of the first binding warp pair 1 formed by the first binding warp 1Bf and the second binding warp 1Bs forms one upper surface side knuckle N1, thereby forming a weaving pattern of passing above one upper surface side weft (1'U and 5'U) and passing below three consecutive upper surface side wefts (2'U to 4'U and 6'U to 8'U), which is a so-called weaving pattern for ⅓ weave. In the same manner, the first warp pair formed by the first binding warps (2Bf to 3Bf and 5Bf to 7Bf) and the second binding warps (2Bs to 3Bs and 5Bs to 7Bs) also forms a weaving pattern for ⅓ weave.

Each warp of the first binding warp pair 1 formed by the first binding warp 1Bf and the second binding warp 1Bs forms one lower surface side knuckle N2, thereby forming a weaving pattern of passing below one lower surface side weft (1'L and 5'L) and passing below three consecutive lower surface side wefts (2'L to 4'L and 6'L to 8'L), which is a weaving pattern for ⅓ weave. In the same manner, the first warp pair formed by the first binding warps (2Bf to 3Bf and 5Bf to 7Bf) and the second binding warps (2Bs to 3Bs and 5Bs to 7Bs) also forms a weaving pattern for ⅓ weave.

Figure 4B:
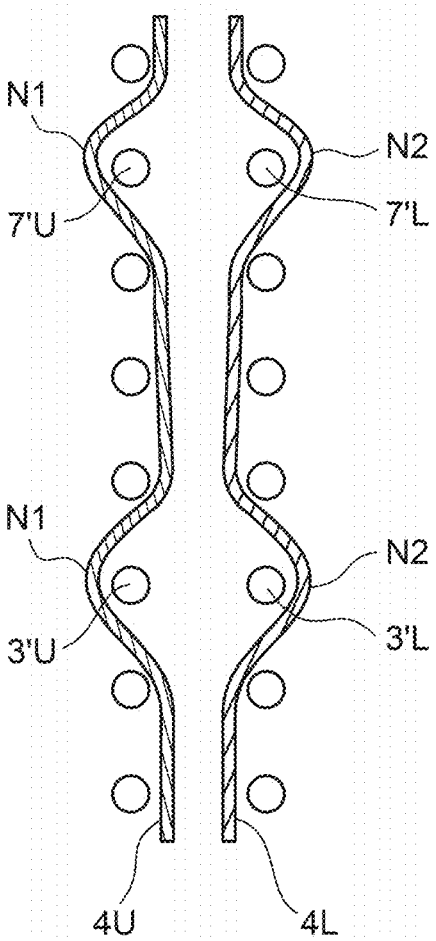

FIG. 4B shows a form in which a second warp pair 4 formed by the upper surface side warp 4U and the lower surface side warp 4L is interwoven with the upper surface side wefts (1'U to 8'U) and the lower surface side wefts (1'L to 8'L).

The upper surface side warp 4U passes above one upper surface side weft (3'U and 7'U) so as to form an upper surface side knuckle N1, passes below three consecutive upper surface side wefts (1'U to 2'U, 4'U to 6'U, and 8'U), and forms a weaving pattern for ⅓ weave. The upper surface side warp 8U has the same weaving pattern as that of the upper surface side warp 4U.

The lower surface side warp 4L passes below one lower surface side weft (3'L and 7'L) so as to form a lower surface side knuckle N2, passes above three consecutive lower surface side wefts (1'L to 2'L, 4'L to 6'L, and 8'L), and forms a weaving pattern for ⅓ weave. The lower surface side warp 8L forms the same weaving pattern for ⅓ weave as that of the lower surface side warp 4L.

In the industrial fabric 100, a weaving pattern is repeated that is formed by three sets of first warp pairs (1 to 3 and 5 to 7) arranged in the weft direction and second warp pairs (4 and 8) arranged being adjacent to the three sets of first warp pairs (1 to 3 and 5 to 7) arranged in the weft direction. Thereby, the ratio of the binding warps can be increased, and the binding force can be improved, and by arranging the second warp pairs apart from each other, the surface smoothness of the upper surface side fabric can be ensured.

The positions of the upper surface side knuckles N1 (marked x and ▲ in FIG. 3) formed by two sets of first warp pairs that are adjacent in the weft direction are shifted by one or more upper surface side wefts in the warp direction. The positions of the upper surface side knuckles N1 (marked x and ▲ in FIG. 3) formed by first warp pairs and upper surface side warps that are adjacent in the weft direction are shifted by one or more upper surface side wefts in the warp direction. Since the upper surface side knuckles N1 are shifted in the warp direction for each adjacent warp pair and arranged, the unevenness of the dewatering speed can be suppressed, thereby preventing the occurrence of poor formation of the paper.

The positions of the lower surface side knuckles N2 (marked ○ and Δ in FIG. 3) formed by two sets of first warp pairs that are adjacent in the weft direction are shifted by one or more lower surface side wefts in the warp direction. The positions of the lower surface side knuckles N2 (marked ○ and Δ in FIG. 3) formed by lower surface side wefts and first warp pairs that are adjacent in the weft direction are shifted by one or more lower surface side wefts in the warp direction. Since the lower surface side knuckles N2 are shifted in the warp direction for each adjacent warp pair and arranged, the unevenness of the dewatering speed can be suppressed, thereby preventing the occurrence of poor formation of the paper.

An industrial fabric according to each of the above exemplary embodiments may be subjected to the following processing. For example, in order to improve the surface smoothness, the obverse surface side of the industrial fabric may be polished in the range of 0.02 to 0.05 mm. In particular, the obverse surface side may be polished by 0.02 mm or 0.03 mm.

Further, in order to suppress the fraying of yarns at the ends of the mesh (industrial fabric), the range of 5 mm to 30 mm, particularly the range of 5 mm, 10 mm, or 20 mm, from the ends of the mesh may be coated with a polyurethane resin for reinforcement. The coating of the mesh ends may be coated on one or both sides. The resin may be hot melt polyurethane.

In order to improve the wear resistance of a mesh end, the mesh may be coated in the range of 20 mm to 500 mm (particularly 25, 50, 75, 100, 150, 250, 300, 350, or 400 mm) from the mesh end with three to sixteen (particularly three, four, seven, eight, ten, twelve, fifteen, or sixteen) strips of resin of a width of about 7 mm over the entire length. The plurality of above-mentioned strips of polyurethane resin may be applied to both ends of the mesh or only to one side. The resin may be hot melt polyurethane.

The entire mesh may be coated with resin in order to improve the antifouling performance. In order to allow for the trimming of the paper making width near the mesh end, the mesh may be coated in the range of 10 mm to 500 mm (particularly 10, 15, 20, 25, 30, 40, 50, 75, 100, 150, 200, 250, 300, 350, or 400 mm) from the mesh end with one strip of resin of a width of about 3, 5, 7, 10, 15, or 20 mm over the entire length. The above-mentioned resin may be applied to both ends of the mesh or only to one side. The resin may be polyurethane and may be hot melt. Further, the mesh may have lines of about 25 mm or 50 mm in width across the entire width so that the line bending of the mesh can be seen during use.

The following is a list of preferred element ranges for an industrial fabric. The diameter of warps is preferably 0.10 mm to 1.0 mm, more preferably 0.1 mm to 0.5 mm, and particularly preferably 0.11 mm to 0.35 mm, where the warps include upper surface side warps, lower surface side warps, first binding warps, and second binding warps. The diameter of the warps may be the same. The diameter of the lower surface side warps may be the same as the diameter of the upper surface side warps or, alternatively, may be set 1.1 to 1.3 times the diameter of the upper surface side warps. The weft diameter is preferably 0.10 mm to 1.0 mm, more preferably 0.12 mm to 0.6 mm, and particularly preferably 0.12 mm to 0.55 mm. The diameter of the lower surface side wefts is desirably larger than the diameter of the upper surface side wefts and may be 1.1 to 3.0 times and more preferably 1.2 to 2.0 times the diameter of the upper surface side wefts.

The upper surface side wefts may be composed of only PET wires, only polyamide wires, or PET wires and polyamide wires that are alternately interwoven. The lower surface side wefts may be composed of only PET wires or only polyamide wires or may be composed of PET wires and polyamide wires that are alternately interwoven. Also, in order to reduce the driving load of the machine, low-friction yarns may be woven with the lower surface side wefts.

The air permeability is preferably 100 $cm^3/cm^2/s$ to 600 $cm^3/cm^2/s$ and more preferably 120 $cm^3/cm^2/s$ to 300 $cm^3/cm^2/s$.

The fabric thickness is preferably 0.3 mm to 3.0 mm, more preferably 0.5 mm to 2.5 mm, and particularly preferably 0.5 mm to 1.0 mm. The usage applications include mainly usage as a papermaking or nonwoven fabric belt and may include particularly usage as a papermaking dewatering belt or a spunbond nonwoven fabric conveying belt.

The cross-sectional shape of the warps and wefts according to each of the above-mentioned exemplary embodiments is not limited to a circular shape, and yarns having a quadrangular shape, a star shape, etc., and yarns having an elliptical shape, a hollow shape, a sheath-core structure shape, etc., can be used. In particular, by making the cross-sectional shape of the lower warps have a square shape, a rectangular shape, or an elliptical shape, the cross-sectional area of the yarns can be increased, and elongation resistance and rigidity can thus be improved.

Further, the yarn material can be freely selected as long as the yarn satisfies the desired characteristics, and polyethylene terephthalate, polyester, polyamide, polyphenylene sulfide, polyvinylidene fluoride, polypropylene, aramid, polyether ether ketone, polyethylene naphthalate, polytetrafluoroethylene, cotton, wool, metals, thermoplastic polyurethane, thermoplastic elastomers, etc., can be used. Needless to say, yarns prepared from a copolymer and yarns prepared by blending or adding various substances to such a material may be used according to the purpose. In general, polyester monofilaments having rigidity and excellent dimensional stability are preferably used as yarns constituting industrial fabrics.

What is claimed is:

1. An industrial fabric that comprises: an upper surface side fabric including upper surface side warps and upper surface side wefts; a lower surface side fabric including lower surface side warps and lower surface side wefts; and binding warps that bind the upper surface side fabric and the lower surface side fabric and that constitute a portion of the upper surface side fabric and a portion of the lower surface side fabric, comprising:

first warp pairs that are each formed by a pair of the binding warps that are vertically adjacent to each other; and second warp pairs that are formed by the upper surface side warps and the lower surface side warps that are vertically adjacent to each other, wherein the upper surface side warps are woven only into the upper surface side wefts, wherein the lower surface side warps are woven only into the lower surface side wefts, and wherein a weaving pattern is repeated that is formed by first warp pairs lined up in sets of three in a weft direction and second warp pairs arranged being adjacent to the first warp pairs lined up in sets of three in the weft direction.

2. The industrial fabric according to claim 1, wherein the pair of binding warps forming the first warp pair is constituted by a first bound warp and a second bound warp, and wherein a range in which the first binding warp and the second binding warp overlap in planar view is less than 50 percent when the upper surface side fabric is viewed in a plane-perpendicular direction.

3. The industrial fabric according to claim 1, wherein warp density DW of warps including the upper surface side warps, the lower surface side warps, and the binding warps calculated by the following Expression 1 is equal to 90 percent or more:

$$DW = (D \times M/25.4) \times 100 \qquad \text{Expression 1}$$

where DW represents the warp density, D represents the diameter (in millimeters) of the upper surface side warps, the lower surface side warps, or the binding warps, and M indicates a mesh count, which refers to the number of warps per inch.

4. The industrial fabric according to claim 1, wherein the binding warps are woven into the upper surface side wefts and the lower surface side wefts in a weaving pattern that is in common with each other.

5. The industrial fabric according to claim 1, wherein the upper surface side warps and the binding warps pass above the upper surface side wefts so as to form upper surface side knuckles, the positions of the upper surface side knuckles formed by two sets of the first warp pairs that are adjacent in the weft direction are shifted by one or more of the upper surface side wefts in the warp direction, the positions of the upper surface side knuckles formed by the first warp pairs and the upper surface side warps that are adjacent in the weft direction are shifted by one or more of the upper surface side wefts in the warp direction.

6. The industrial fabric according to claim 1, wherein warps located on the upper surface side including the upper surface side warps and the binding warps form a weaving pattern where the upper surface side wefts are woven above and below alternately one by one.

7. The industrial fabric according to claim 1, wherein the lower surface side warps and the binding warps pass below the lower surface side wefts so as to form lower surface side knuckles, the positions of the lower surface side knuckles formed by two sets of the first warp pairs that are adjacent in the weft direction are shifted by one or more of the lower surface side wefts in the warp direction, and the positions of the lower surface side knuckles formed by the lower surface side warps and the first warp pairs that are adjacent in the weft direction are shifted by one or more of the lower surface side wefts in the warp direction.

8. The industrial fabric according to claim 1, wherein warps located on the lower surface side including the lower surface side warps and the binding warps repeatedly form a weaving pattern of passing below one of the lower surface side wefts and then passing above three consecutive lower surface side wefts.

9. The industrial fabric according to claim 1, wherein one set of the second warp pairs is arranged adjacent to each of the sides of three consecutive sets of the first warp pairs while three consecutive sets of the first warp pairs are arranged on each of the sides of one set of the second warp pairs.

* * * * *